US005156106A

United States Patent [19]

Suzuki et al.

[11] Patent Number: 5,156,106

[45] Date of Patent: Oct. 20, 1992

[54] SEWING MACHINE WITH AUTOMATIC THREAD CUTTER

[75] Inventors: Hajime Suzuki, Nagoya; Kazuhisa Ito, Aichi, both of Japan

[73] Assignee: Brother Kogyo Kabushiki Kaisha, Nagoya, Japan

[21] Appl. No.: 872,329

[22] Filed: Apr. 23, 1992

[30] Foreign Application Priority Data

May 20, 1991 [JP] Japan ..... 3-143918

[51] Int. Cl.[5] ..... D05B 69/26; D05B 27/22; D05B 65/00

[52] U.S. Cl. ..... 112/275; 112/300; 112/315; 112/262.1

[58] Field of Search ..... 112/275, 277, 315, 316, 112/300, 121.11, 314, 262.1, 285, 291, 292

[56] References Cited

U.S. PATENT DOCUMENTS

| | | | |
|---|---|---|---|
| 4,137,860 | 2/1979 | Yoneji et al. | 112/277 |
| 4,516,514 | 5/1985 | Neki et al. | 112/275 |
| 4,732,099 | 3/1988 | Neki et al. | 112/275 |
| 4,858,541 | 8/1989 | Ozawa | 112/315 X |
| 5,042,408 | 8/1991 | Suzuki et al. | 112/292 |

FOREIGN PATENT DOCUMENTS

| | | |
|---|---|---|
| 2-136165 | 5/1990 | Japan . |
| 2-283397 | 11/1990 | Japan . |

*Primary Examiner*—Peter Nerbun
*Attorney, Agent, or Firm*—Oliff & Berridge

[57] ABSTRACT

In a sewing machine, when the depressed condition of a foot pedal is changed from a forward depressed condition for high speed sewing to a reverse depressed condition for thread cutting, a braking circuit decreases the rotational speed of the machine motor from a high speed to a low speed. The rotational speed is detected by an encoder. When the rotational speed detected by the encoder becomes a threshold medium speed or less, and a needle-down signal is generated from a needle position detector, the CPU of the sewing machine outputs a work fabric feed pitch control start signal to a work fabric feed pitch selector. The work fabric feed pitch selector reduces or nullifies the feed pitch of the work fabric. Under this condition, in response to the next needle-down signal, the CPU operates a thread cutting mechanism to cut the needle and bobbin threads.

16 Claims, 6 Drawing Sheets

Fig.4B

| ITEM | INSTRUCTIONS |
|---|---|
| S1 | HIGH SPEED ROTATION SIGNAL ? |
| S2 | HIGH SPEED ROTATION ON |
| S3 | THREAD CUTTING COMMAND ? |
| S4 | HIGH SPEED ROTATION OFF; LOW SPEED ROTATION ON |
| S5 | THRESHOLD MEDIUM SPEED ? |
| S6 | NEEDLE DOWN ? |
| S7 | WORK FABRIC FEED PITCH CONTROL START SIGNAL ON |
| S8 | NEEDLE DOWN ? |
| S9 | THREAD CUTTING OPERATION SIGNAL ON |
| S10 | NEEDLE UP ? |
| S11 | WORK FABRIC FEED PITCH CONTROL START SIGNAL OFF; THREAD CUTTING OPERATION SIGNAL OFF; LOW SPEED ROTATION OFF |
| S12 | BRAKE OPERATION SIGNAL ON FOR 40 MILLISECONDS |
| S13 | STOP COMMAND ? |
| S14 | HIGH SPEED ROTATION OFF; LOW SPEED ROTATION ON |
| S15 | LOW SPEED ROTATION OFF |

SEWING MACHINE WITH AUTOMATIC THREAD CUTTER

BACKGROUND OF THE INVENTION

1. Field of the Invention

The invention relates to a sewing machine with an automatic thread cutter for carrying out a thread cutting operation after reducing or nullifying a feed pitch of a work fabric.

2. Description of the Related Art

A conventional sewing machine with an automatic thread cutter is provided with a thread terminal holding device for holding a terminal portion of a needle thread carried by a needle over a machine bed and releasing the thread terminal portion at the start of the next sewing, so as to shorten a residual length of the thread terminal portion upon cutting of the needle thread in association with the end of sewing. In the case of a sewing machine that is not provided with the above thread terminal portion holding device, there is a possibility that a stitch is not formed (skip stitch) or the needle thread is taken out of an eyelet of the needle because of the enlargement of a needle thread loop by a rotating hook or lifting of a thread take-up lever at starting of the sewing (first stitch), which causes an increase in the residual length of the thread terminal portion after thread cutting. This increase in residual length greatly damages the appearance of a sewn fabric, and it is troublesome in that an operator must later cut the thread terminal portion with scissors or the like.

In the sewing machine with the thread terminal portion holding device, the needle thread held by the thread terminal portion holding device can be released at an arbitrary timing in association with the start of sewing. Therefore, the skip stitch or the release of the needle thread from the eyelet of the needle can be prevented to thereby shorten the residual length of the thread terminal portion.

The shorter the residual length of the thread terminal portion, the shorter the length of the needle thread extending from the sewn fabric. Accordingly, it is not necessary to cut the thread terminal portion later, and catching of the thread terminal portion by a second stitch or subsequent stitches is prevented.

In the conventional sewing machine with the automatic thread cutter, a feed pitch of the work fabric is reduced or made zero upon thread cutting to further shorten the residual length of the thread terminal portion. This is due to the following reason.

Thread cutting is performed during a period of time from the time when the needle comes out of the work fabric to the time when the needle reaches a top dead center of the stitching stroke. On the other hand, feeding of the work fabric is also performed during a period of time while the needle is separate from the work fabric. Accordingly, in order to prevent the work fabric from being fed a great distance during a period of time until the thread cutting is actually performed, and the needle thread being drawn from the eyelet of the needle to lengthen the thread terminal portion, the feed pitch of the work fabric is reduced or made zero upon initiation of the thread cutting operation.

FIG. 5 shows a timing chart of the feed pitch during the thread cutting operation.

When a foot pedal is reverse depressed, that is a heel portion of the pedal is depressed, by an operator to start the thread cutting operation at the end of sewing of the work fabric, a thread cutting command signal is input to shift a rotational speed of the machine motor from a high speed to a low speed. After the low speed has been reached, a needle position signal (a detection signal at a bottom dead center position of the needle in this timing chart) is detected. According to this detection signal, a work fabric feed pitch control start signal for reducing the feed pitch of the work fabric is output. After the work fabric is fed at the reduced pitch, the thread cutting is started according to a thread cutting operation signal. At the time the thread cutting is ended, the feeding of the work fabric by the machine motor is stopped.

Thus, in the conventional sewing machine with such an automatic thread cutter, after the rotational speed of the machine motor has completely shifted over to the low speed, then the needle position signal is detected to carry out the thread cutting operation. As a result, a considerable period of time is required from the time when the thread cutting command signal is input to the time when the thread cutting operation is ended, thus reducing the work rate of the operator.

SUMMARY OF THE INVENTION

It is an object of the present invention to shorten the period of time from the decrease in the rotational speed of the machine motor from a high speed to the end of the thread cutting operation, thereby improving the work rate.

According to the invention, there is provided a sewing machine with an automatic thread cutter, comprising: speed command means for generating a speed command signal for decreasing a rotational speed of a machine motor from a high speed to a low speed; thread cutting means for cutting a needle thread and a bobbin thread; feed pitch changing means for reducing a work fabric feed pitch of at least one stitch just before thread cutting according to the speed command means; threshold detecting means for detecting a threshold medium speed during decreasing of the rotational speed of the machine motor by the speed command means; feed pitch control means for driving the feed pitch changing means after detection of the threshold medium speed by the threshold detecting means; and thread cutting control means for generating a thread cutting operation signal to the thread cutting means after driving of the feed pitch changing means by the feed pitch control means.

With this structure, the threshold detecting means detects a predetermined threshold medium speed of the machine motor in the course of decreasing from a high speed of the machine motor during sewing of a work fabric to a low speed of the machine motor. After the threshold medium speed is detected, the feed pitch control means drives the feed pitch changing means to reduce or nullify a feed pitch of the work fabric. Thereafter, the thread cutting control means outputs a thread cutting operation signal to the thread cutting means to start a thread cutting operation.

As is apparent from the above description, the threshold medium speed is detected in the course of decreasing from the high speed of the machine motor for the work fabric sewing operation to the low speed of the machine motor for the thread cutting operation. According to a detection signal of the threshold medium speed, the work fabric feed pitch is reduced or made zero to quickly carry out the thread cutting operation. Accordingly, as compared with the conventional sewing machine wherein a work fabric feed pitch control signal is generated after the rotational speed of the machine motor has been reduced to the low speed, the working period for thread cutting is shortened so that the work rate of the operator can be greatly improved to thereby improve productivity.

BRIEF DESCRIPTION OF THE DRAWINGS

A preferred embodiment of the present invention will be described in detail with reference to the following figures, wherein:

FIG. 4B is a table of labels for the flowchart of FIG. 4A; and

DETAILED DESCRIPTION OF THE PREFERRED EMBODIMENTS

There will now be described a preferred embodiment of the present invention with reference to the drawings.

Figure 1:
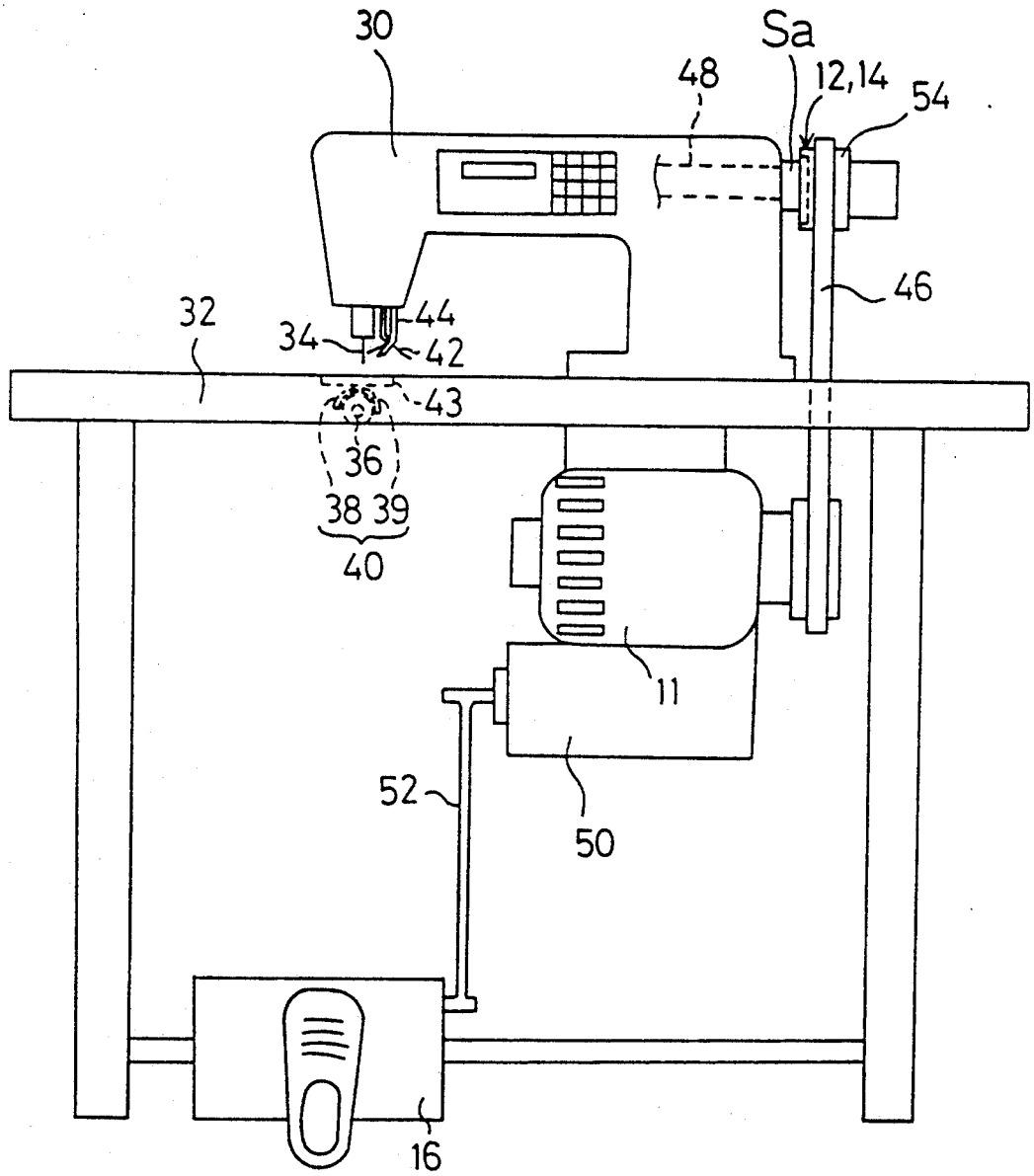
FIG. 1 is a front elevation of a sewing machine with an automatic thread cutter according to a preferred embodiment of the present invention.

Referring to FIG. 1, a machine head 30 of a sewing machine provided with an automatic thread cutter according to the preferred embodiment is mounted on a working table 32. The machine head 30 has a needle 34 cooperating with a rotating hook 36 to form a number of stitches. The machine head 30 is provided with a thread cutting mechanism 40 having a moving blade 38 and a stationary blade 39 located below a throat plate 43 to cut a needle thread 42 and a bobbin thread (not shown). The machine head 30 is further provided with a thread terminal holding device 44 for holding a thread terminal of the cut needle thread 42 and releasing the thread terminal at the start of the next sewing operation.

A machine motor 11 is mounted under the working table 32. The machine motor 11 drives an upper shaft 48 through a belt 46 and a pulley 54 is fixed to the upper shaft 48. A control box 50 for controlling rotation of the machine motor 11 is fixed under the machine motor 11. A foot pedal 16 for selecting a rotational speed of the machine motor 11 between a high speed and a low speed is located below the control box 50. The foot pedal 16 is connected, through a connecting rod 52, to the control box 50. A needle position detector 14 for detecting a needle position of the needle 34 is fixed to a left side surface of the pulley 54.

A detailed mechanical structure of the sewing machine with an automatic thread cutter much as described above is described in U.S. Pat. No. 5,042,408, for example, and so a detailed explanation of the mechanical structure will be omitted with U.S. Pat. No. 5,042,408 being incorporated herein by reference.

Figure 2:
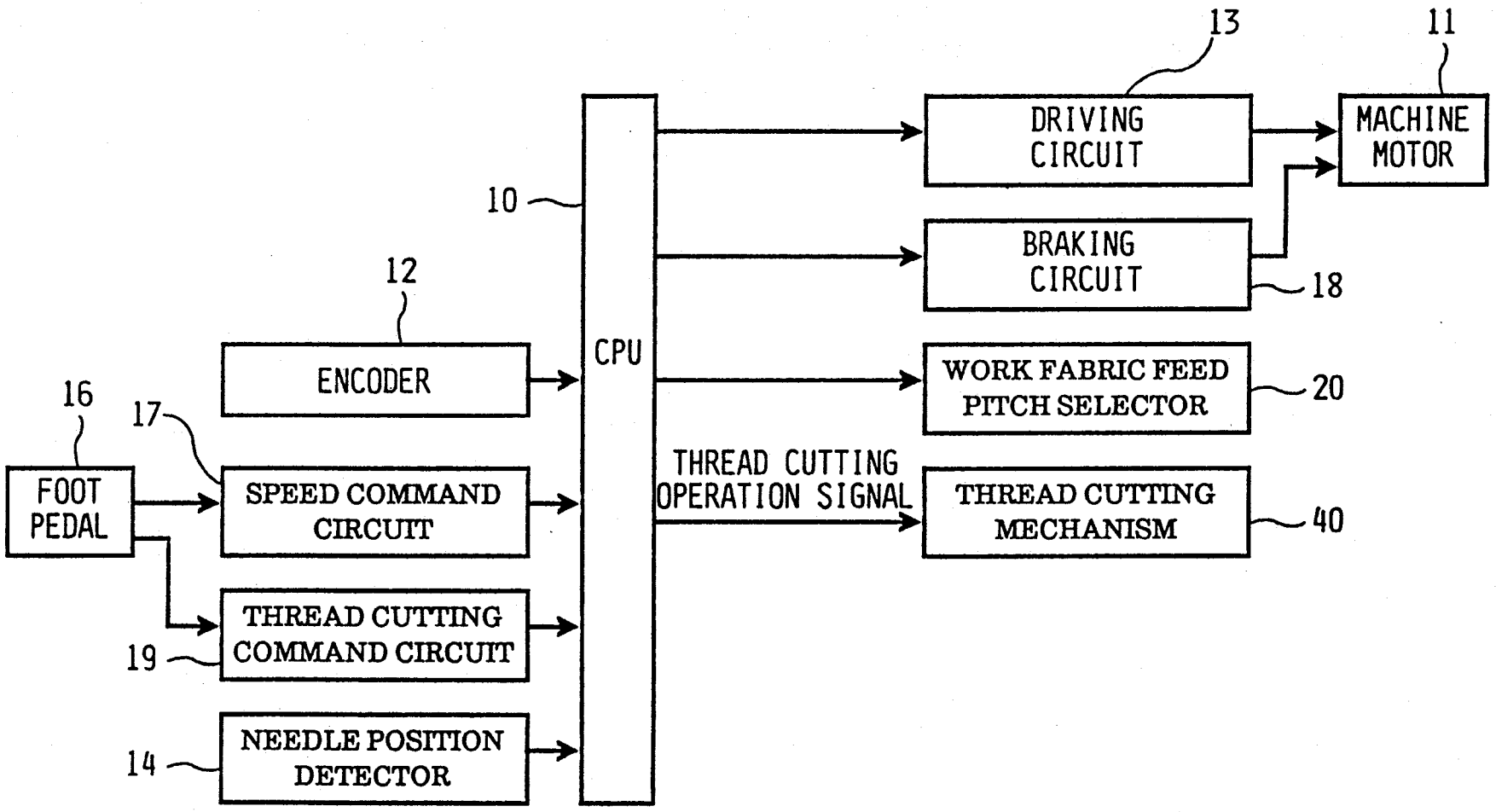
FIG. 2 is a block diagram illustrating an electrical structure of the sewing machine shown in FIG. 1.

FIG. 2 shows a block diagram of the sewing machine with the automatic thread cutter according to the preferred embodiment.

Referring to FIG. 2, reference numeral 10 denotes a central processing unit (CPU) connected with an encoder 12, a speed command circuit 17, a thread cutting command circuit 19 and the needle position detector 14. The encoder 12 is mounted on the upper shaft 48 to detect the rotating speed of the upper shaft 48 of the machine head 30 and output a detection signal of the rotating speed to the CPU 10. The needle position detector 14, comprising a reflecting plate and a photo sensor, is provided on the left side surface of the pulley 54 to detect a needle-up position near a top dead center of the stroke of the needle 34 and a needle-down position near a bottom dead center of the stroke of the needle 34. The speed command circuit 17 outputs a high speed rotation signal to the CPU 10 under the condition where the toe portion of the foot pedal 16 is depressed, and when the foot pedal 16 is changed to the condition where the heel portion is depressed, the speed command circuit 17 outputs a change signal for changing the high speed rotation to the low speed rotation. The thread cutting command circuit 19 outputs a thread cutting command signal when the condition of the foot pedal 16 is changed to the heel portion depressed condition.

The CPU 10 is further connected with a driving circuit 13, a braking circuit 18, a work fabric feed pitch selector 20 and the thread cutting mechanism 40. The driving circuit 13 drives the machine motor 11. The braking circuit 18 changes the rotational speed of the machine motor 11 from a high speed to a low speed. The work fabric feed pitch selector 20 comprises an actuator and a selecting mechanism. When the low speed rotation of the machine motor 11 is selected, the feed pitch of a work fabric is reduced or made zero by the work fabric feed pitch selector 20 (the feed pitch is reduced in the preferred embodiment). The thread cutting mechanism 40 cuts the needle thread 42 and the bobbin thread by the cooperation of the moving blade 38 and the stationary blade 39 during the low speed rotation of the machine motor 11.

The rotation speed of the machine motor 11 is detected as the rotation speed of the upper shaft 48. The rotational speed of the machine motor 11 during the high speed rotation is set to about 4000–5000 stitches/minute and the rotational speed during the low speed rotation is set to about 200 stitches/minute.

Figure 3:
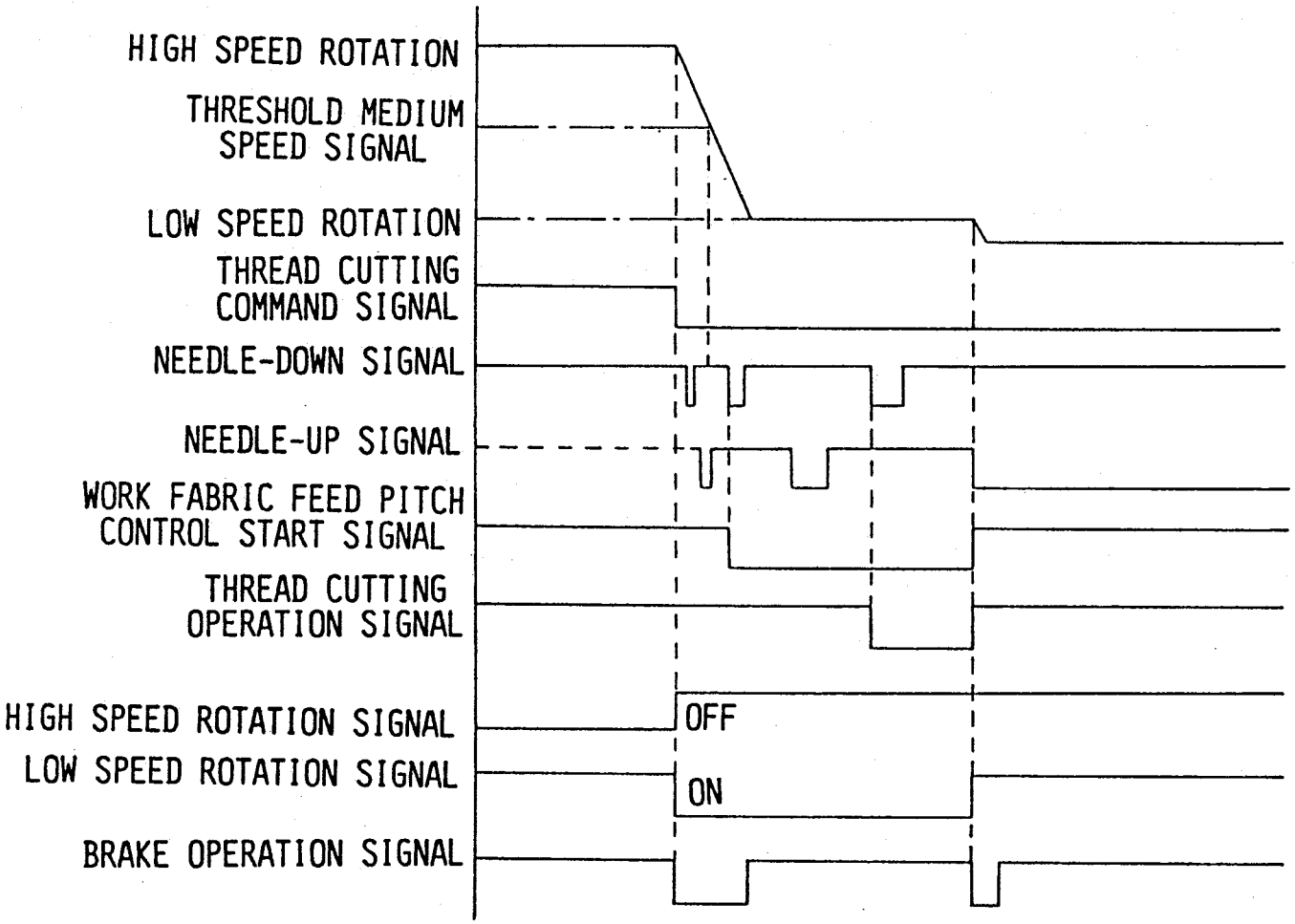
FIG. 3 is a timing chart in the electrical structure shown in FIG. 2.

FIG. 3 shows a timing chart for the control system shown in FIG. 2.

When the heel portion of the foot pedal 16 is depressed for the thread cutting operation after the finish of sewing of the work fabric, the thread cutting command circuit 19 outputs a thread cutting command signal to the CPU 10. At the same time, the speed command circuit 17 outputs a high speed rotation OFF signal and a low speed rotation ON signal of the machine motor 11 to the CPU 10. Upon receipt of these signals, the CPU 10 outputs a brake operation signal to the braking circuit 18. Then, the braking circuit 18 decreases the rotational speed of the machine motor 11 from the high speed to the low speed. A predetermined threshold medium speed (about 2000 stitches/minute) is passed in the course of shifting from the high speed rotation to the low speed rotation. When the rotational speed of the machine motor 11, detected by the encoder 12, reaches the threshold medium speed the encoder 12 outputs a threshold medium speed signal to the CPU 10.

When the needle position detector 14 outputs the first needle-down signal after the generation of the threshold medium speed signal from the encoder 12, the CPU 10 outputs a work fabric feed pitch control start signal to the work fabric feed pitch selector 20. The work fabric feed pitch selector 20 then reduces the work fabric feed pitch. This is possible because when the needle 34 is present near the bottom dead center of its stroke, a feed dog (not shown) is present under the throat plate 43, which is convenient for implementing the change in the work fabric feed pitch. At the time when the next needle-down signal is output from the needle position detector 14, the CPU 10 outputs a thread cutting operation signal to the thread cutting mechanism 40. Then, the thread cutting mechanism 40 starts the thread cutting operation of the needle thread 42 and the bobbin thread. The reason why the thread cutting operation signal is output at the same time the needle-down signal is output is that there exists a time lag caused by the mechanism from the output time of the thread cutting operation signal to the time the moving blade 38 actually moves, and the needle thread 42 and the bobbin thread are to be cut at a position near the work fabric stitch while the moving blade 38 does not interfere with the needle 34. The end of the thread cutting operation is detected according to an output of the subsequent needle-up signal by the needle position detector 14. At the same time, the work fabric feed pitch control start signal, the thread cutting operation signal and the low speed rotation ON signal, having been continued throughout this period, are cut off. Thereafter, the brake is operated for 40 milliseconds to stop the machine motor 11.

Figure 4A:
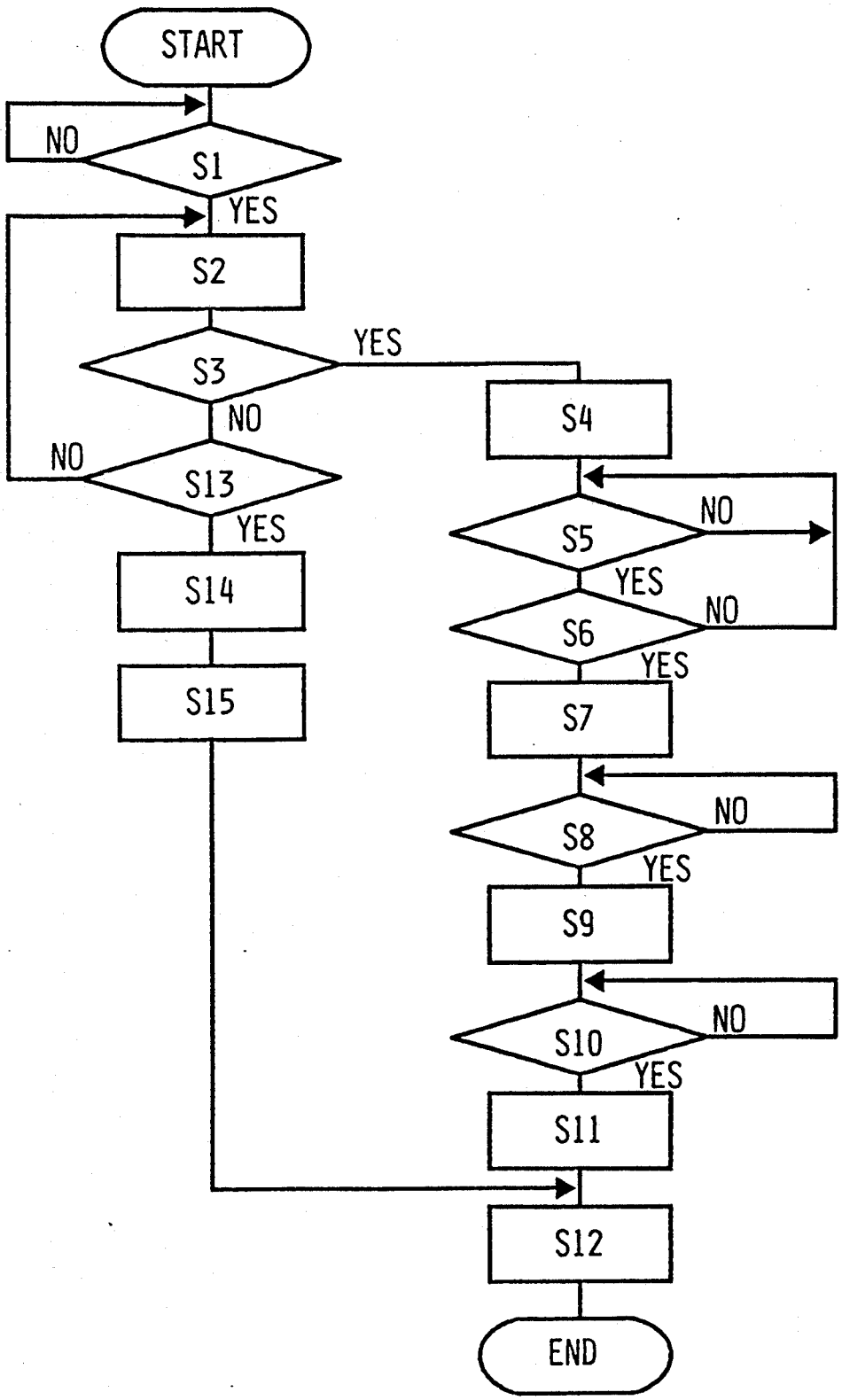
FIG. 4A is a flowchart illustrating a control operation of the sewing machine shown in FIG. 1.
Figure 5:
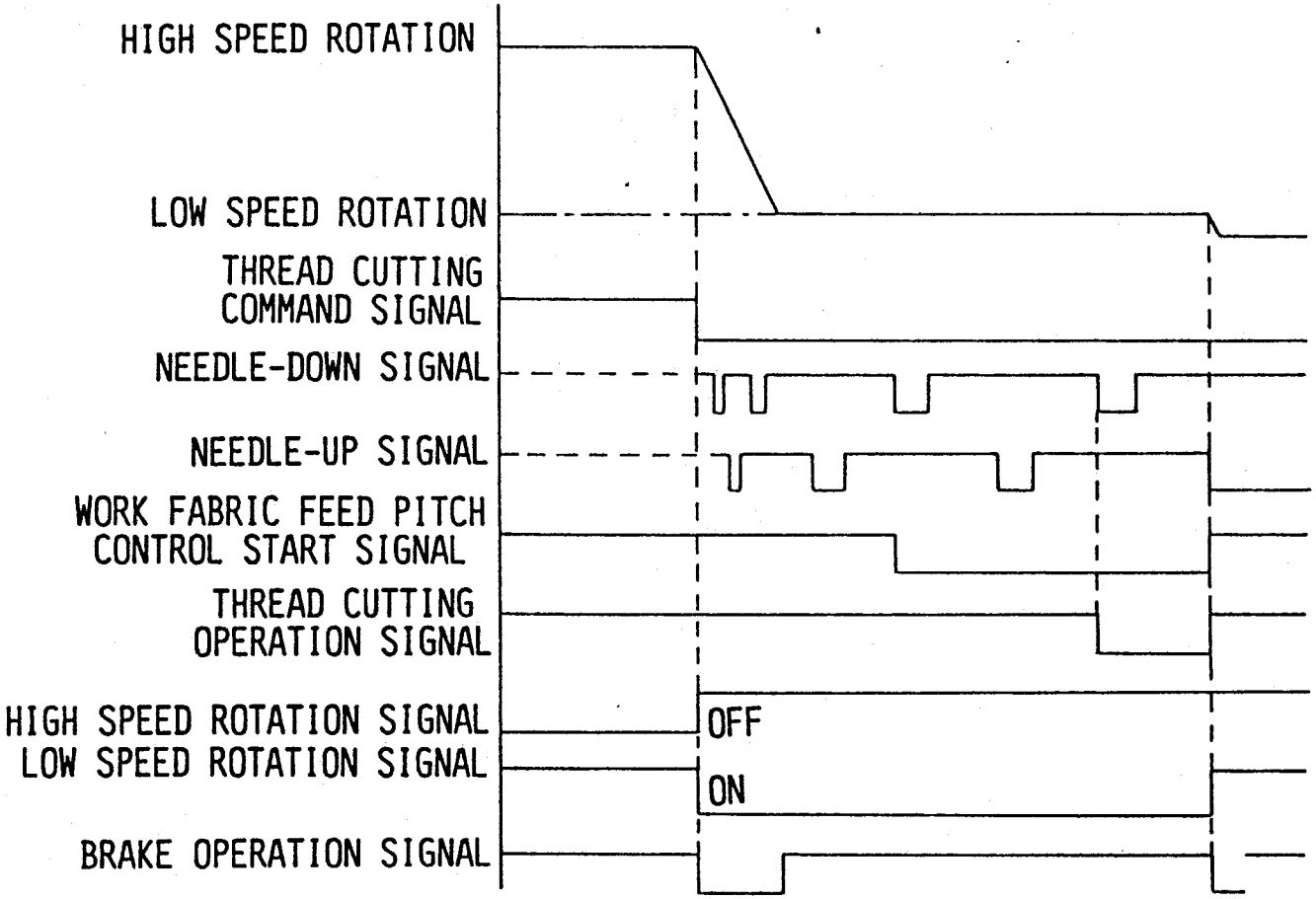
Fig.5 RELATED ART
FIG. 5 is a timing chart in an electrical structure of a sewing machine with an automatic thread cutter in the prior art.

FIGS. 4A and 4B are a flowchart, with labels, of the control operation for the sewing machine in the preferred embodiment.

In step S1, the CPU 10 determines whether the speed command circuit 17 has output a high speed rotation signal to the machine motor 11 according to a forward, or toe portion, depression of the foot pedal 16. If NO in step S1, the CPU 10 awaits the output of the high speed rotation signal, while if YES in step S1, the CPU 10 outputs the high speed rotation signal to the driving circuit 13 and the driving circuit 13 accordingly drives the machine motor 11 to rotate at a high speed in step S2. In step S3, the CPU 10 determines whether the thread cutting command circuit 19 has output a thread cutting command signal according to a reverse, or heel portion, depression of the foot pedal 16. If the answer is YES, then at the same time that the thread cutting command signal is output, the speed command circuit 17 outputs a high speed rotation OFF signal and a low speed rotation ON signal. Therefore, if YES in step S3, the program proceeds to step S4, in which the driving circuit 13 drives the machine motor 11 to rotate at a low speed.

In step S5, the CPU 10 determines whether the encoder 12 has output a threshold medium speed signal. If NO in step S5, the CPU 10 awaits the output of the threshold medium speed signal. If YES in step S5, that is, if the CPU 10 determines that the rotational speed of the machine motor 11 has decreased to a threshold value or less, the program proceeds to step S6 in which the CPU 10 determines whether the needle position detector 14 has output a needle-down signal. If NO in step S6, the program returns to step S5, while if YES in step S6, the CPU 10 outputs a work fabric feed pitch control start signal to the work fabric feed pitch selector 20 and, on that basis, the work fabric feed pitch selector 20 reduces the feed pitch of the work fabric.

In step S8, the CPU 10 again determines whether the needle position detector 14 has output a needle-down signal. In this case, it is the next needle-down signal after the feed pitch has changed. If NO in step S8, the CPU 10 awaits the output of the needle-down signal, while if YES in step S8, the CPU 10 outputs a thread cutting operation signal to the thread cutting mechanism 40. The thread cutting mechanism 40 then executes the thread cutting operation of the needle thread 42 and the bobbin thread.

In step S10, the CPU 10 determines whether the needle position detector 14 has output a needle-up signal. If NO in step S10, the CPU 10 awaits the output of the needle-up signal, while if YES in step S10, the program proceeds to step S11 in which the CPU 10 cuts off the work fabric feed pitch control start signal, the thread cutting operation signal and the low speed rotation ON signal. In step S12, the CPU 10 outputs a brake operation signal to the braking circuit 18 and the brake is operated for 40 milliseconds to stop the machine motor 11.

Back in step S3, if the CPU 10 determines that no thread cutting command signal has been output, the program proceeds to step S13, in which the CPU 10 determines whether a command signal for stopping the driving of the machine motor 11 has been output. If NO in step S13, the program returns to step S2, while if YES in step S13, the program proceeds to step S14, in which the CPU 10 outputs a high speed rotation OFF signal and a low speed rotation ON signal. Thereafter, in step S15, the CPU 10 cuts off the low speed rotation ON signal, and then the program proceeds to step S12.

Although the feed pitch of the work fabric is reduced in the preferred embodiment described above, the feed pitch may be made zero rather than reduced.

What is claimed is:

1. A sewing machine with an automatic thread cutter, comprising:

speed command means for generating a speed command signal for decreasing a rotational speed of a machine motor from a high speed to a low speed;

thread cutting means for cutting a needle thread and a bobbin thread;

feed pitch changing means for reducing a work fabric feed pitch of at least one stitch just before thread cutting according to said speed command means;

threshold detecting means for detecting a threshold medium speed during decreasing of the rotational speed of said machine motor by said speed command means;

feed pitch control means for driving said feed pitch changing means after detection of said threshold medium speed by said threshold detecting means; and thread cutting control means for generating a thread cutting operation signal to said thread cutting means after driving of said feed pitch changing means by said feed pitch control means.

2. The sewing machine as defined in claim 1, further comprising needle position detecting means for detecting a needle-up position where a needle is present near a top dead center of a needle stroke and a needle-down position where the needle is present near a bottom dead center of the needle stroke, wherein when the needle-down position is detected by said needle position detecting means after the threshold medium speed has been detected, said feed pitch changing means is driven by said feed pitch control means.

3. The sewing machine as defined in claim 2, wherein when the needle-down position is detected by said needle position detecting means after said feed pitch changing means is driven, the thread cutting operation signal is output from said thread cutting control means to said thread cutting means.

4. The sewing machine as defined in claim 1, wherein the reducing of a work fabric feed pitch includes reduction to a zero feed pitch.

5. The sewing machine as defined in claim 2, wherein when the needle-up position is detected after said thread cutting control means has generated the thread cutting operation signal, said speed command means generates a brake signal for stopping rotation of the machine motor.

6. A thread cutting method by an automatic thread cutter in a sewing machine, comprising the steps of:

decreasing a rotational speed of a machine motor from a high speed to a low speed;

detecting a threshold medium speed during decreasing of the rotational speed of said machine motor by the decreasing step;

reducing a work fabric feed pitch of at least one stitch after detection of the threshold medium speed by the detecting step; and cutting a needle thread and a bobbin thread after execution of the reducing step.

7. The thread cutting method of claim 6, further comprising the step of:

detecting a first needle-down position immediately after detecting a threshold medium speed to initiate the step of reducing a work fabric feed pitch.

8. The thread cutting method of claim 7, further comprising the step of:

detecting a second needle-down position after detecting a threshold medium speed to initiate the cutting step, said second needle-down position being a first needle-down occurrence after a reduction in the work fabric feed pitch.

9. The thread cutting method of claim 6, wherein the reducing of a work fabric feed pitch includes reduction to a zero feed pitch.

10. The thread cutting method of claim 6, further comprising the step of braking the machine motor to stop rotation upon detecting a needle-up position after the cutting step has been initiated.

11. A sewing machine with an automatic thread cutter, comprising:

speed command means for generating a speed command signal for decreasing a rotational speed of a machine motor from a high speed to a low speed;

thread cutting means for cutting a needle thread and a bobbin thread;

feed pitch changing means for reducing a work fabric feed pitch of at least one stitch just before thread cutting according to said speed command means;

threshold detecting means for detecting a threshold medium speed during decreasing of the rotational speed of said machine motor by said speed command means;

feed pitch control means for driving said feed pitch changing means after detection of said threshold medium speed by said threshold detecting means;

thread cutting control means for generating a thread cutting operation signal to said thread cutting means after driving of said feed pitch changing means by said feed pitch control means; and needle position detecting means for detecting a needle-up position where a needle is present near a top dead center of a needle stroke and a needle-down position where the needle is present near a bottom dead center of the needle stroke, wherein when the needle-down position is detected by said needle position detecting means after the threshold medium speed has been detected, said feed pitch changing means is driven by said feed pitch control means.

12. The sewing machine as defined in claim 11, wherein when the needle-down position is detected by said needle position detecting means after said feed pitch changing means is driven, the thread cutting operation signal is output from said thread cutting control means to said thread cutting means.

13. The sewing machine as defined in claim 12, wherein when the needle-up position is detected by said needle position detecting means, a work fabric feed pitch control start signal is terminated.

14. The sewing machine as defined in claim 12, wherein when the needle-up position is detected by said needle position detecting means, the thread cutting operation signal is terminated.

15. The sewing machine as defined in claim 12, wherein when the needle-up position is detected by said needle position detecting means, the low speed rotational speed of the machine motor is terminated.

16. The sewing machine as defined in claim 15, further comprising a brake for the machine motor, wherein when the low speed is terminated, the brake is activated to stop the machine motor.

* * * * *